US010653251B1

(12) United States Patent
Young

(10) Patent No.: US 10,653,251 B1
(45) Date of Patent: May 19, 2020

(54) CHILD CARRIER HAVING SELECTIVELY ADJUSTABLE SIDE PANELS FOR INWARD FACING AND OUTWARD FACING CHILD CARRYING POSITIONS

(71) Applicant: Mary Elizabeth Young, South Jordan, UT (US)

(72) Inventor: Mary Elizabeth Young, South Jordan, UT (US)

( * ) Notice: Subject to any disclaimer, the term of this patent is extended or adjusted under 35 U.S.C. 154(b) by 0 days.

(21) Appl. No.: 16/363,811

(22) Filed: Mar. 25, 2019

(51) Int. Cl.
*A47D 13/02* (2006.01)
*A47D 15/00* (2006.01)

(52) U.S. Cl.
CPC ..... *A47D 13/025* (2013.01); *A47D 15/006* (2013.01)

(58) Field of Classification Search
CPC .... A47D 13/025; A47D 13/02; A47D 15/008; A47D 15/00
See application file for complete search history.

(56) References Cited

U.S. PATENT DOCUMENTS 7,766,199 B1 * 8/2010 Caperon ..... A47D 13/025 224/160
8,172,116 B1 5/2012 Lehan et al.
8,272,546 B2 * 9/2012 Leistensnider ..... A47D 13/025 224/158
8,424,732 B1 4/2013 Lehan et al.
8,701,949 B1 4/2014 Lehan et al.
9,357,852 B2 * 6/2016 Salazar ..... A47D 13/025
9,386,863 B1 7/2016 Antunovic
2004/0238579 A1 * 12/2004 Krogh ..... A47D 13/025 224/160
2005/0242136 A1 * 11/2005 Moriguchi ..... A47D 13/025 224/160
2014/0263491 A1 * 9/2014 Telford ..... A47D 13/025 224/160
2017/0150826 A1 * 6/2017 Salazar ..... A47D 13/025
2018/0184813 A1 * 7/2018 Salazar ..... A47D 13/025
2018/0199730 A1 * 7/2018 Lundh ..... A47D 13/025
2019/0014920 A1 * 1/2019 Matsuyama ..... A47D 13/025

OTHER PUBLICATIONS

Oct. 17, 2016 Tradeshow, Happy Baby display by inventor Mary Elizabeth Young.
Baby Tula Explore Baby Carrier available at least as early as Sep. 2018, https://www.amazon.com/Baby-Tula-Explore-Carrier-Easy/dp/B07GSG7Q7P/ref=cm_cr_arp_d_product_top?ie=UTF8.
(Continued)

*Primary Examiner* — Derek J Battisti
(74) *Attorney, Agent, or Firm* — Durham Jones & Pinegar; Sarah W. Matthews

(57) ABSTRACT

A baby carrier is described, which beneficially includes multiple positions for carrying a baby, including inwardly and outwardly facing positions. The baby carrier includes a main panel having cut-outs on both sides of the main panel, and two selectively adjustable side panels. The side panels may be connected in an inward-facing position where they cover the cut-outs, or an outward-facing position where they fold down and expose the cut-outs such that a baby's legs may pass through. In some examples, padding or foam is selectively placed within the selectively adjustable side panels and/or the main panel to support the baby in a spread-squat position in the outward-facing position.

20 Claims, 6 Drawing Sheets

(56) References Cited

OTHER PUBLICATIONS

BabyBjorn Carrier One, available at least as early as Jan. 2016, https://www.amazon.com/gp/product/B016DAW918/?tag=lucslis-20&th=1.
Beco 8 Baby Carrier, available at least as early as Feb. 2017, https://www.amazon.com/Beco-Baby-Carrier-Dark-Grey/dp/B01N6S15ZA/?tag=lucslis-20&th=1.
Boba X Carrier, available at https://boba.com/collections/boba-x/products/boba-x-seafoam.
Ergobaby 360, available at least as early as Sep. 2013.
Ergobaby Omni 360, available for purchase at least as early as Jul. 2017.
Lillebaby Complete Baby carrier, available at least as early as Nov. 2013.
Tula Free-to-grow Coast baby carrier, available for purchase at least as early as Mar. 23, 2019.

* cited by examiner

CHILD CARRIER HAVING SELECTIVELY ADJUSTABLE SIDE PANELS FOR INWARD FACING AND OUTWARD FACING CHILD CARRYING POSITIONS

TECHNICAL FIELD

The present invention relates generally to a baby or child carrier. More specifically, the present invention relates to a baby carrier having selectively adjustable side panels to allow a user to carry the baby in an inward facing position or an outward facing position.

BACKGROUND

Many child carriers are available which allow a caregiver to carry a child and still have use of their hands. Such carriers often have fairly complicated designs and can be bulky, require inserts for use with different sized babies, etc., resulting in an unpleasing aesthetic and difficulty of use for the caregiver. If the child carrier allows for a multiplicity of carrying positions (such as front carrying, back carrying, child facing inward carrying and child facing outward carrying), these problems are often compounded by the components needed to adapt the carrier for the various positions.

Thus, there is a need for a baby carrier which may be adjusted to allow for multiple types of carrying positions. It may also be advantageous if the baby carrier allows for ergonomic positioning for the baby and the caregiver in the various carrying positions.

SUMMARY OF INVENTION

A baby carrier is described herein, comprised of a main panel and two selectively adjustable side panels. Each of the side panels may have a first position for an inward-facing carry and a second position for an outward-facing carry. The main panel may have a first cut-out extending from one opposing side edge towards the middle, and a second cut-out extending from a second opposing side edge towards the middle. The cut-outs may have a generally arcuate shape such that the main panel forms a generally hourglass shape.

The main panel may have a front side and a back side, and the back side may have two sets of connectors for connecting the selectively adjustable side panels, one set of connectors to connect the side panels to the back of the main panel in an inward-facing position and at least one connector for connecting the side panels to the back of the main panel in an outward-facing position.

According to one aspect, a first connector may be attached to the back side of the main panel proximal to the first opposing side edge and above the first arcuate cut-out, and a second connector attached to the back side of the main panel proximal to the second opposing side edge and above the second arcuate cut-out, the first connector configured to mate with a first side panel connector located proximal to a top of a first selectively adjustable side panel and the second connector configured to mate with a second side panel connector located proximal to a top of a second selectively adjustable side panel.

According to another aspect, a third connector may be attached to the back side of the main panel in the middle portion and below the first and second connectors, the third connector configured to mate with the first and second side panel connectors on the first and second selectively adjustable side panels. In other configurations, a third and fourth connector may be provided, the third and fourth connectors attached to the back side of the main panel in the middle portion and below the first and second connectors.

The two selectively adjustable side panels may have two different, optionally changeable positions: an inward facing position when the first selectively adjustable side panel is connected to the first connector of the main panel and the second selectively adjustable side panel is connected to the second connector of the main panel, and an outward facing position when the first and second selectively adjustable side panels are connected to the third connector of the main panel.

According to another aspect, the main panel further comprises padding within the bottom portion of the main panel. In some configurations, this padding comprises a first piece of foam disposed on one side of the middle portion and a second piece of foam disposed on the other side of the middle portion. The padding may aid in proper positioning of the baby in a spread-squat position in the outward-facing configuration of the carrier.

According to yet another aspect, the first and second selectively adjustable side panels further comprise padding located within the first and second selectively adjustable side panels. The padding may comprise a piece or portion of soft foam. In some configurations, the padding of the side panels may work in conjunction with the padding at the bottom portion of the main panel to support the hips of the baby in an outward-facing configuration.

BRIEF DESCRIPTION OF DRAWINGS

The following drawings illustrate what are currently considered to be specific representative configurations for carrying out the invention and are not limiting as to embodiments which may be made in accordance with the present invention. The components in the drawings are not necessarily to scale relative to each other. Like reference numerals designate corresponding parts throughout the several views.

The drawings are illustrative and not limiting of the scope of the invention which is defined by the appended claims. The various elements of the invention accomplish various aspects and objects of the invention. Not every element of the invention can be clearly displayed in a single drawing, and as such not every drawing shows each element of the invention.

DETAILED DESCRIPTION

Figure 1:
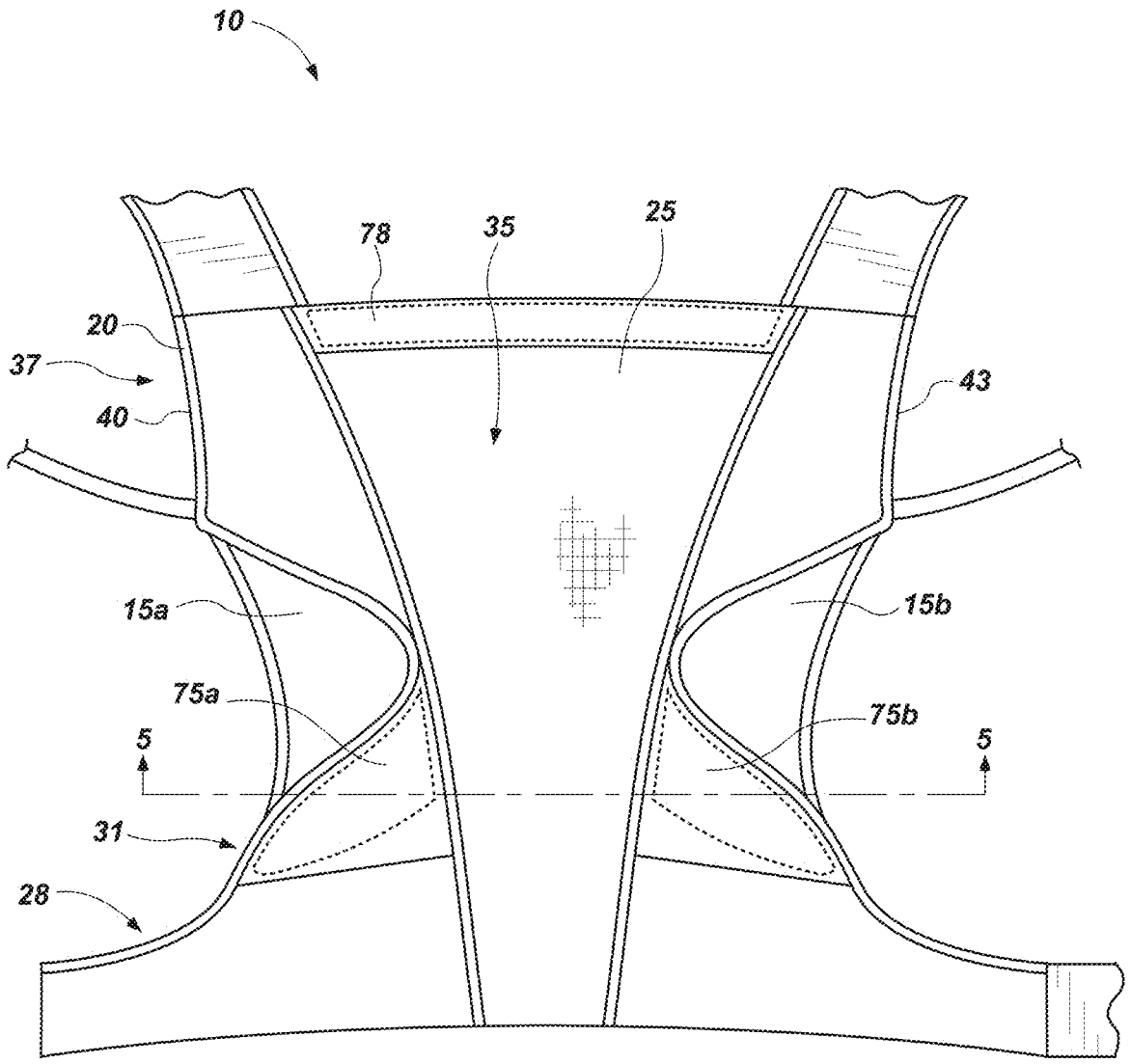
FIG. 1 is a plan view of the front side of a baby carrier with the selectively adjustable side panels in an inward-facing position.

The following provides a detailed description of particular embodiments of the present invention. Reference will now be made to the drawings in which the various elements of the illustrated configurations will be given numerical designations and in which the invention will be discussed so as to enable one skilled in the art to make and use the invention. It is to be understood that the following description is only exemplary of the principles of the present invention, and should not be viewed as narrowing the scope of the claims which follow, which claims define the full scope of the invention.

It will be appreciated that various aspects discussed in one drawing may be present and/or used in conjunction with the embodiment shown in another drawing, and each element shown in multiple drawings may be discussed only once. For example, in some cases, detailed description of well-known items or repeated description of substantially the same configurations may be omitted. The reason is to facilitate the understanding of those skilled in the art by avoiding the following description from being unnecessarily redundant. The accompanying drawings and the following description are provided in order for those skilled in the art to fully understand the present disclosure, and these are not intended to limit the gist disclosed in the scope of claims.

It should be noted that the description merely illustrates the principles of the present subject matter. It will thus be appreciated that those skilled in the art will be able to devise various arrangements that, although not explicitly described herein, embody the principles of the present subject matter and are included within its spirit and scope. Furthermore, all examples recited herein are principally intended expressly to be only for pedagogical purposes to aid the reader in understanding the principles of the invention and the concepts contributed by the inventor(s) to furthering the art, and are to be construed as being without limitation to such specifically recited examples and conditions. Moreover, all statements herein reciting principles, aspects, and embodiments of the invention, as well as specific examples thereof, are intended to encompass equivalents thereof.

Reference in the specification to "one configuration" "one embodiment," "a configuration" or "an embodiment" means that a particular feature, structure, or characteristic described in connection with the configuration is included in at least one configuration, but is not a requirement that such feature, structure or characteristic be present in any particular configuration unless expressly set forth in the claims as being present. The appearances of the phrase "in one configuration" in various places may not necessarily limit the inclusion of a particular element of the invention to a single configuration, rather the element may be included in other or all configurations discussed herein.

Furthermore, the described features, structures, or characteristics of configurations of the invention may be combined in any suitable manner in one or more configurations. In the following description, numerous specific details are provided, such as examples of products or manufacturing techniques that may be used, to provide a thorough understanding of configurations of the invention. One skilled in the relevant art will recognize, however, that configurations of the invention may be practiced without one or more of the specific details, or with other methods, components, materials, and so forth. In other instances, well-known structures, materials, or operations are not shown or described in detail to avoid obscuring aspects of the invention.

The present disclosure is not limited to any particular structures, process steps, or materials discussed or disclosed herein, but is extended to include equivalents thereof as would be recognized by those of ordinary skill in the relevant art. More specifically, the invention is defined by the terms set forth in the claims. Terminology herein is used for the purpose of describing particular aspects of the invention only and is not intended to limit the invention to the aspects or configurations shown unless expressly indicated. Likewise, the discussion of any particular aspect of the invention is not to be understood as a requirement that such aspect is required to be present apart from an express inclusion of the aspect in the claims.

It should also be noted that, as used in this specification and the appended claims, singular forms such as "a," "an," and "the" may include the plural unless the context clearly dictates otherwise. Thus, for example, reference to "a connector" may include one or more of such connectors, and reference to "the selectively adjustable side panel" may include reference to one or more of such selectively adjustable side panels.

As used herein the term "generally" refers to something that is more of the designated adjective than not, or the converse if used in the negative. For example, something maybe said to be generally arcuate even though it has a somewhat v-shape or arc-shape rather than being completely arcuate.

As used herein, the term "about" is used to provide flexibility to a numerical range endpoint by providing that a given value may be "a little above" or "a little below" the endpoint while still accomplishing the function associated with the range.

As used herein, a plurality of items, structural elements, compositional elements, and/or materials may be presented in a common list for convenience. However, these lists should be construed as though each member of the list is individually identified as a separate and unique member.

Sizes, proportions and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually. This same principle applies to ranges reciting only one numerical value as a minimum or a maximum. Furthermore, such an interpretation should apply regardless of the breadth of the range or the characteristics being described.

The present invention generally relates to baby carrier that comprises selectively adjustable side panels to allow for a multiplicity of caring positions. Although the carrier is generally referred to herein as a "baby" carrier because it is often used to carry babies, the term "baby" is used for ease of references and is not limiting. The carrier can be used to carry infants, babies, toddlers, and children, and "baby" as used herein refers to infants, babies, toddlers, children, etc., who may be carried in the carrier.

As used herein, the term "front side" refers to portions of the baby carrier that are seen by a third person viewing the baby carrier as it is worn on a caregiver. As used herein, the term "back side" refers to portions of the baby carrier that face the caregiver as they wear the baby carrier.

One embodiment of the present disclosure is shown and described in the baby carrier of FIG. 1. FIG. 1 is a plan view of a baby carrier, generally indicated at 10, with the selectively adjustable side panels 15 in position for inward-facing carrying, as seen from the front side 20. The baby carrier may generally include a main panel 25, and first and second selectively adjustable side panels 15. The main panel 25 forms an area to carry a child in cooperation with a caregiver or wearer's torso.

In some configurations, the main panel 25 generally consists of four portions: a waist support portion 28, a bottom portion 31, a middle portion 35, and a top portion 37. The main panel 25 may also comprise a first opposing side edge 40 and a second opposing side edge. The waist support portion 28 may be connected on one side to a buckle, ring, clip, or other connector, and on the other side to a waist strap. In use, the waist strap and the waist support portion 28 form together a continuous band around the user's waist to hold much of the weight of the infant, baby, toddler, or child being carried on the hips of the caregiver or user.

Figure 3:
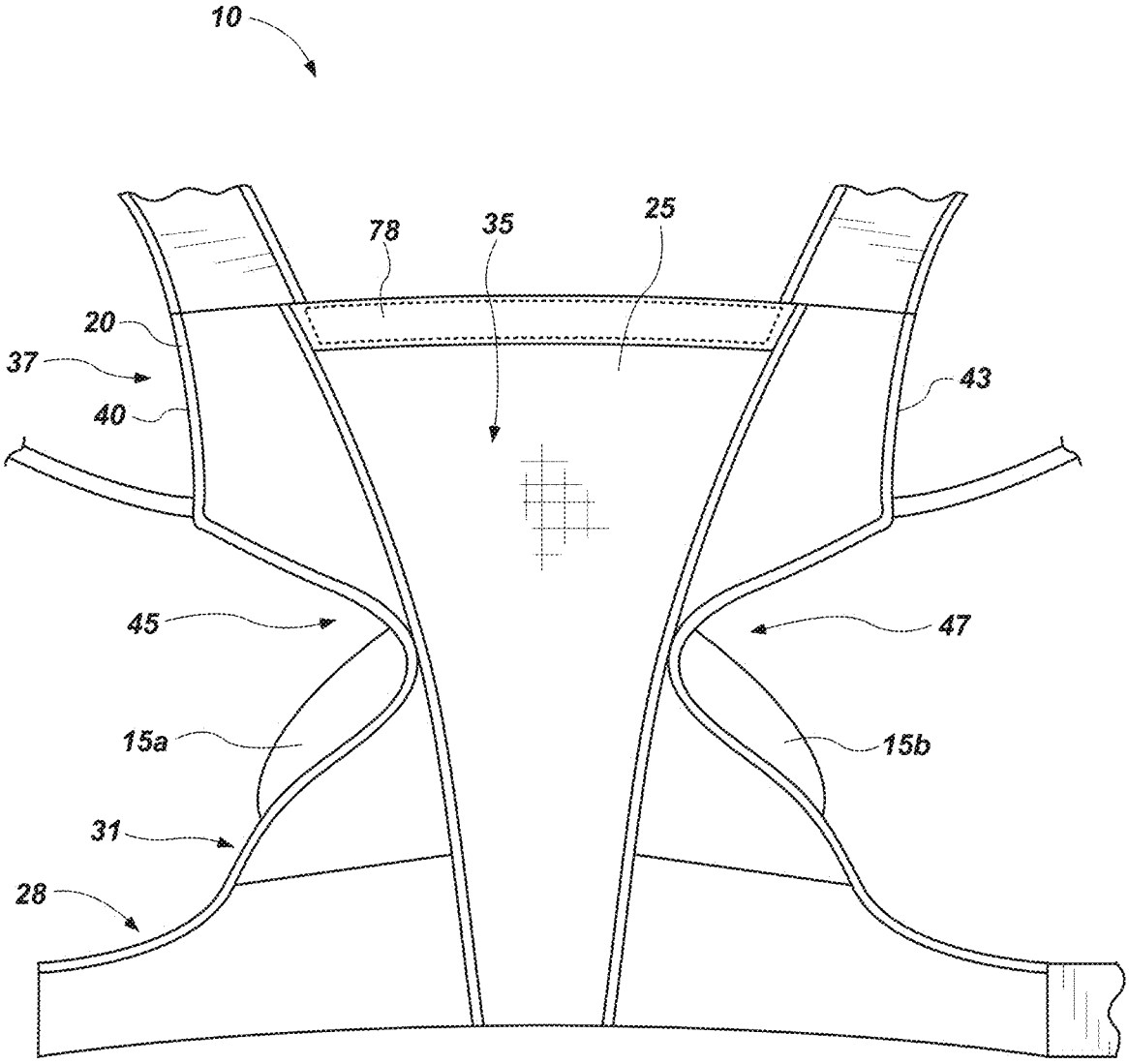
FIG. 3 is a plan view of the front side of a baby carrier with the selectively adjustable side panels in an outward-facing position.

The main panel 25 may further comprise two cut-outs formed therein such that the main panel 25 forms a generally hourglass shape. While the cut-outs shown in the figures have a generally arcuate shape, they can also be other shapes, such as a U-shape, a V-shape, etc., and "arcuate shape" refers to any shape of such cut-outs. In FIG. 1, the cut-outs allow the selectively adjustable side panels 15*a*, 15*b* (which are attached to the back side of the baby carrier) to be viewed from the front side 20 of the baby carrier 10. In FIG. 3, the selectively adjustable side panels 15*a*, 15*b* are moved into an outward-facing position, and the first cut-out 45 and the second cut-out 47 are more clearly visible.

Figure 4:
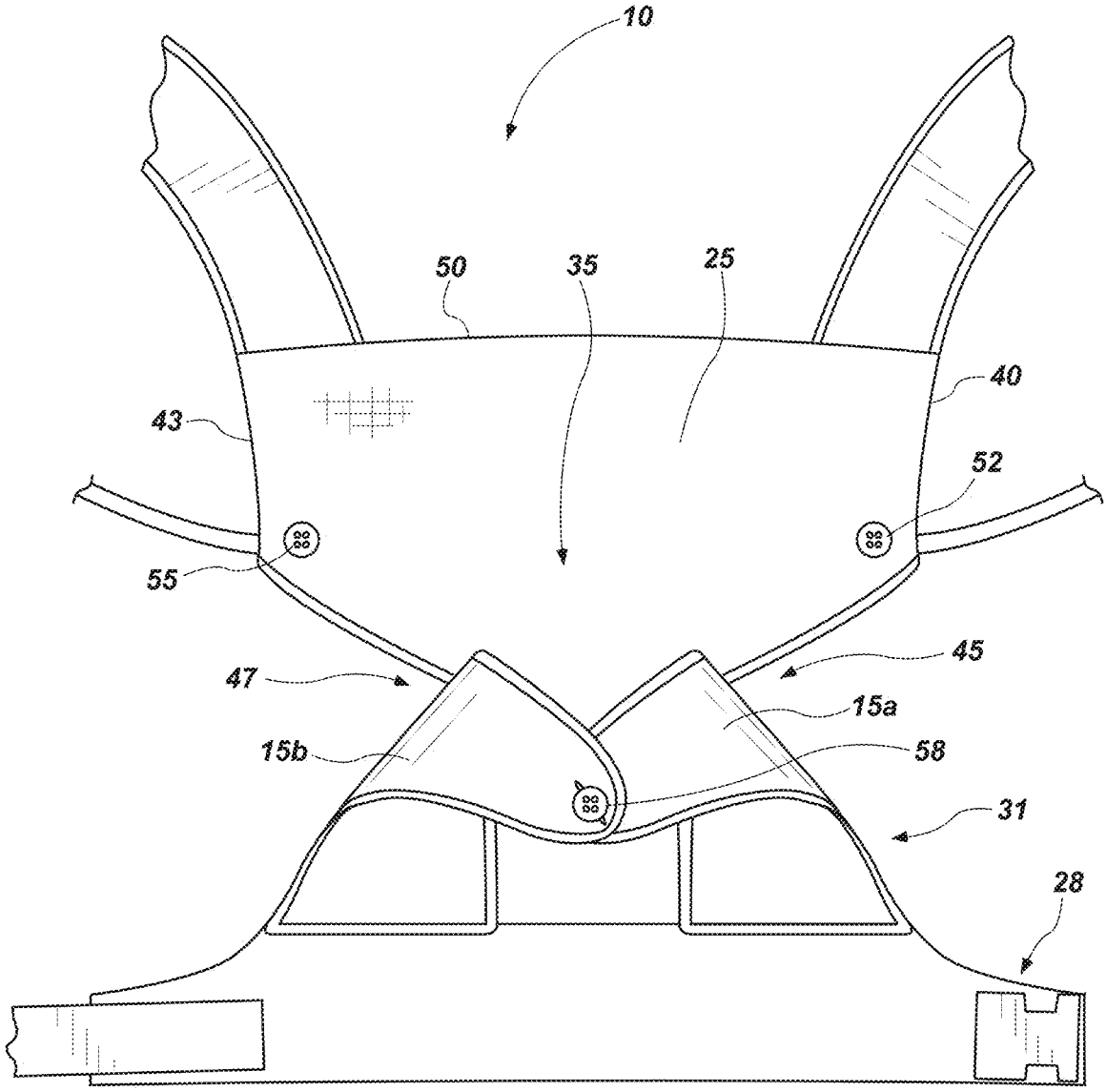
FIG. 4 is a plan view of the back side of a baby carrier with the selectively adjustable side panels in an outward-facing position.

The first cut-out 45 may be formed in the main panel 25 from the first opposing side edge 40 towards the middle portion 35 of the main panel 25. The second cut-out 47 may be formed in the main panel 25 from the second opposing side edge 43 towards the middle portion 35 of the main panel 25. These cut-outs may give the main panel 25 a generally hour-glass shape. The cut-outs 45, 47 can be either covered from behind by the selectively adjustable side panels 15 (as shown in FIG. 1) for an inward-facing carrying position, or the cut-outs 45, 47 can be at least partially uncovered such that they form a space for a baby's legs to be positioned in an outward-facing carrying position (as shown in FIGS. 3, 4). In FIG. 3, a baby's legs may pass through the cut-outs 45, 47 in an outward-facing carrying position.

The back side 50 of the main panel 25 may include three connectors: two (52, 55 in FIGS. 2, 4) for connecting each of the selectively adjustable side panels 15*a*, 15*b* in an inward facing position, and one (58 in FIGS. 2, 4) for connecting both of the selectively adjustable side panels 15*a*, 15*b* in an outward-facing position. While the figures show the connectors 52, 55, and 58 as buttons on the back of the main panel 25 (with mating button-openings on the selectively adjustable side panels), many types of connectors may be used, for example: buttons, hook-and-eye, Velcro, buckles, hook-and-loop, toggle fasteners, grommets/eyelets, etc.

The first connector 52 may be attached to the back side of the main panel 25 proximal to the first opposing side edge 40 and above the first cut-out 45. A mating side panel connector (shown as buttonhole 61 in FIG. 2) may be attached proximal to the top of the selectively adjustable side panel 15*a* for connecting the top of the selectively adjustable side panel 15*a* to the back side 50 of the main panel 25 proximal to the first opposing side edge 40 and above the first cut-out 45. Connected in this manner, the selectively adjustable side panel 15*a* covers the opening or cut-out 45 of the main panel 25 to form a configuration for carrying a baby in an inward-facing position. The selectively adjustable side panel 15*a* may be non-removably attached at its bottom edge to the bottom portion 31 of the main panel.

Similarly, a second connector 55 may be attached to the back side 50 of the main panel 25 proximal to the second opposing side edge 43 and above the second arcuate cut-out 47. A mating side panel connector (buttonhole 64) may be attached proximal to the top of the selectively adjustable side panel 15*b* for connecting the top of the selectively adjustable side panel 15*b* to the back side 50 of the main panel 25 proximal to the second opposing side edge 43 and above the second arcuate cut-out 47. The selectively adjustable side panel 15*b* may be non-removably attached at its bottom edge to the bottom portion 31 of the main panel.

When the first and second selectively adjustable side panels 15*a*, 15*b* are each connected to the first and second connectors 52, 55, respectively, the selectively adjustable side panels 15*a*, 15*b* cover each of the arcuate openings 45, 47 of the main panel 25 to form a configuration for carrying a baby in an inward-facing position. In this position, the middle portion 35 of the main panel supports the middle of the baby's back, and the side panels 15*a*, 15*b* each support a side of the baby's back.

In some configurations, a third connector 58 may be attached to the back side 50 of the main panel 25 in or proximal to the middle portion 35 and below the first and second connectors 52, 55. Similar to the first and second connectors, this third connector 58 may be configured to mate with the section connectors (button holes 61, 64) attached proximal to the top of the first and second selectively adjustable side panels 15*a*, 15*b*. This third connector 58 may be configured to accept both the connectors on each of the selectively adjustable side panels. Or, if it is not desired to provide a single attachment point for both of the selectively adjustable side panels, additional connectors may be provided. For example, in some configurations, a third and a fourth connector may be provided, each of the third and the fourth connectors attached to the back side of the main panel proximal to the middle portion and below the first and second connectors. In such a configuration, each of the third and fourth connectors may accept one of the mating connectors attached proximal to the top of the first and second selectively adjustable side panels.

When both the first and second selectively adjustable side panels 15*a*, 15*b* are each connected to the third connector 58 (or a third and fourth connector, respectively), the selectively adjustable side panels 15*a*, 15*b* uncover at least a portion of each of the arcuate openings 45, 47 of the main panel 25 to form a configuration for carrying a baby in an outward-facing position. In this position, the middle portion 35 of the main panel supports the baby's torso, and the uncovered portions of each of the openings 45, 47 allow a space for the baby's legs to pass through. The folded-over side panels further support the baby's hips in an ergonomic position, as described in additional detail below.

With two sets of connectors (i.e., connectors 52, 55 provided on the back side 50 of the main panel 25 proximal to each opposing side edge 40, 43 and above the arcuate cut-outs 45, 47, and third connector 58 provided on the back side 50 of the main panel 25 proximal to the middle 35 and below the first and second connectors), there are two different possible positions for the first and second selectively adjustable side panels 15*a*, 15*b*. In an inward-facing position, the first and second side panels 15*a*, 15*b* are attached to the first and second connectors 52, 55, respectively, proximal to each opposing side edge and above the arcuate cut-outs, such that the side panels cover the cut-outs 45, 47 of the main panel 25. In other words, side panels 15*a*, 15*b* in this inward facing position cover the cut-outs 45, 47 from the main panel 25 from behind (when viewed from the front side 20 of the carrier). This may form a space, in conjunction with the caregiver's torso, for an infant, baby, toddler, or child to be carried in an inward-facing position (i.e., facing the caregiver).

In an outward-facing position, the first and second side panels 15*a*, 15*b* may both be attached to the third connector 58 (or to a third and fourth connector in some configurations) which may be connected to the back 50 of the middle portion 35 of the main panel 25 and below the first and second connectors, such that the side panels 15*a*, 15*b* do not entirely cover the cut-outs 45, 47, and the baby's legs may pass through the cut-outs 45, 47 in an outward-facing position (i.e., facing away from the caregiver).

In some configurations, the selectively adjustable side panels may be sewn to the front side 20 of the carrier. In other configurations, the selectively adjustable side panels 15*a*, 15*b* may be entirely removable from the carrier 10. For example, the bottom edge of side panels 15*a*, 15*b* may be attached to one-half of a zipper, with the second half of the zipper being on the main panel. The side panels 15*a*, 15*b* may be zipped to the main panel for the inward-facing position, and then unzipped and entirely removed for the outward-facing position. Other fasteners may also be used to selectively attach and remove the side panels 15*a*, 15*b* from the carrier 10.

In some configurations, it may be desirable to provide filling, padding, foam or other material within one or more sections of the baby carrier to aid in ergonomic positioning of the carrier both for the caregiver and for the infant, baby, toddler, or child. For example, shoulder straps may include a foam between two or more pieces of material that form the shoulder strap. According to one aspect, each of the selectively adjustable side panels 15*a*, 15*b*, may be provided with padding, such as foam or another material or filling. For example, foam such as expanded polystyrene, polyethylene, polyurethane, or any other suitable foam know in the art may be used. The foam may have any desired thickness, and in some configurations the foam may have a thickness of about 0.5 centimeters to about 2 centimeters.

Figure 2:
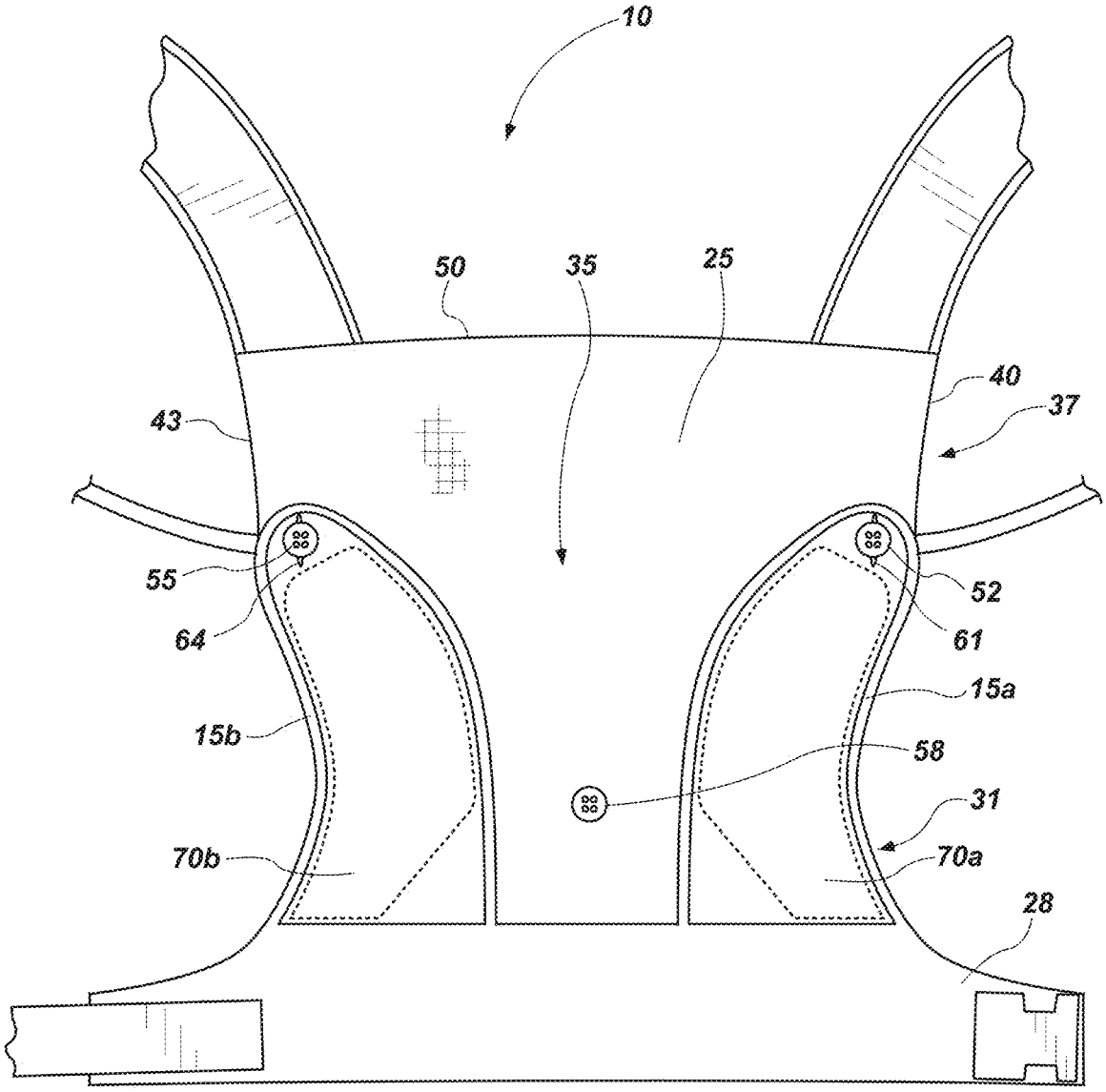
FIG. 2 is a plan view of the back side of a baby carrier with the selectively adjustable side panels in an inward-facing position.

The padding, foam, material, or filling may be placed in the side panel 15*a*, 15*b* below the mating connector (to reduce bulk near the mating connector and make connection to the main panel connections easier), and extend to the bottom of the side panel (location of filling shown in dashed lines at 70*a*, 70*b* in FIG. 2, as filling is located within the side panels; see also FIG. 5, cut-away view along line 5-5 of FIG. 1). As seen in FIG. 2, padding 70*a*, 70*b* may be omitted proximal to the inward, bottom side edges of the side panels 15*a*, 15*b* to reduce bulk and make it easier for the side panels to be folded inward to connect to the third connector 58 for the outward-facing carry. As seen in FIG. 2, a single piece of foam 70*a*, 70*b* (shown in dashed lines within side panels 15*a*, 15*b*) may be used. It will be appreciated that multiple pieces of foam or other filling or padding may also be used.

Figure 6:
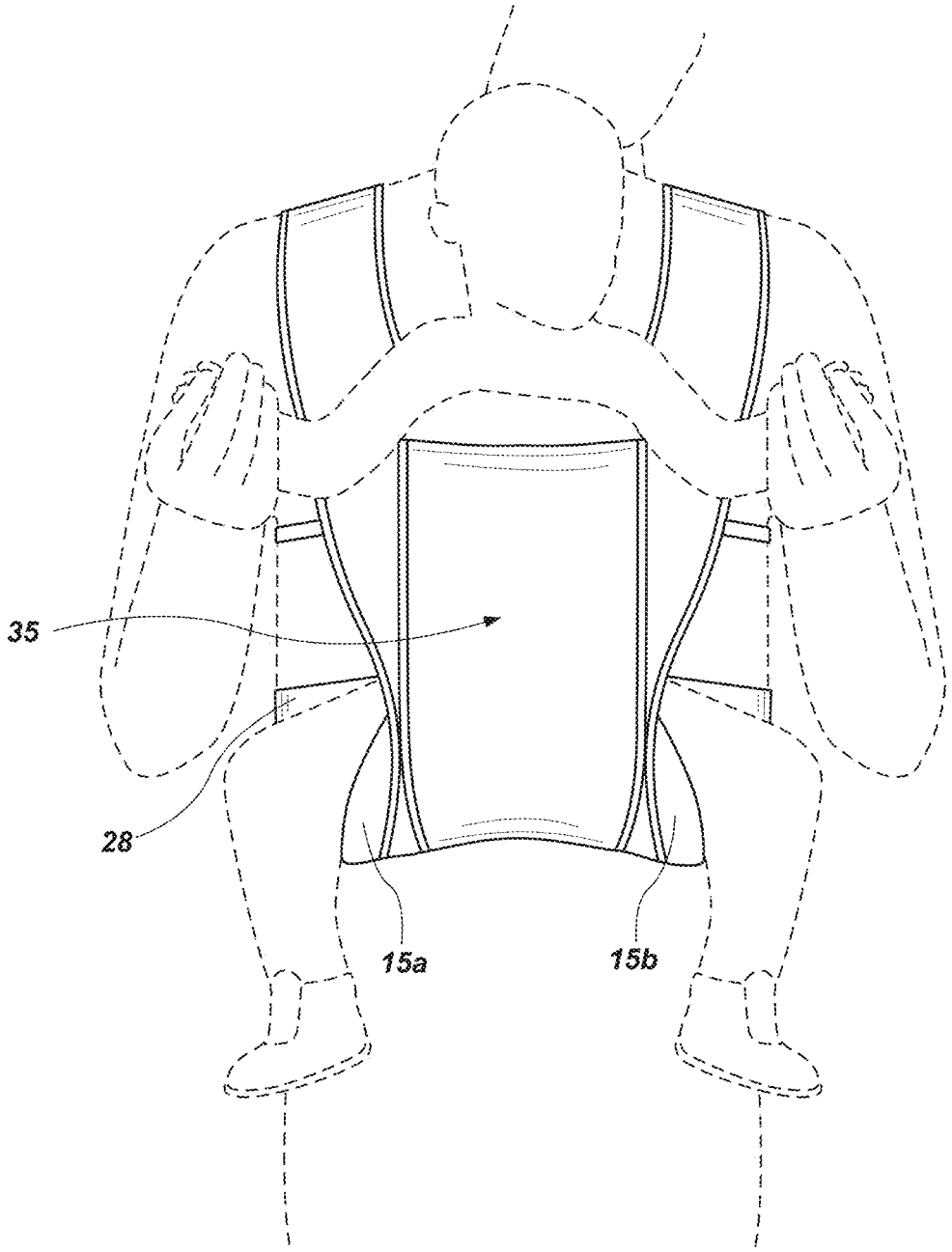
FIG. 6 is a front perspective view of a baby carrier with a baby being carried therein, the caregiver holding the baby in an outward-facing position.

The padding provided within the selectively adjustable side panels 15*a*, 15*b* may provide further structure to the carrier, particularly in an outward-facing position. In an outward-facing position with each of the selectively adjustable side panels 15*a*, 15*b* connected to the third connector 58 at the back side 50 of the main panel 25 proximal to the middle portion 35 (see FIG. 4), the selectively adjustable side panels 15*a*, 15*b* are each folded downward towards the middle. In use, the baby's legs pass through the cut-outs 45, 47 and will be on top of the folded side panels 15*a*, 15*b* (see FIG. 6 for view with a baby located in a carrier in the outward-facing carrying position). The addition of padding to the side panels 15*a*, 15*b* allows the baby's legs to be further supported by the carrier 10. The best position to promote healthy development of spine and hip for babies is the spread squat position because it stimulates the optimum growth of the hip joints. If the baby's weight is placed on the groin and their legs left dangling straight down, it can be harmful for physiological developmental of the hips. Providing padding (such as foam 70*a*, 70*b* seen in FIG. 2) within the selectively adjustable side panels 15*a*, 15*b* which are folded for the outward-facing position encourages support of the baby's hips in the physiologically preferred spread-squat position.

To further encourage proper support of the baby in a spread-squat position, padding, such as foam or filling as described above, may be provided in the main panel (this padding may be in additional to, or alternative to the padding in the selectively adjustable side panels). The padding may be placed proximal to or within the bottom portion 31 of the main panel 25 (padding is shown as a single piece of foam 75*a*, 75*b* in dashed lines in FIG. 1). In some configurations, the padding located in the main panel 25 may have an increased firmness and/or an increased thickness compared to the padding located in the selectively adjustable side panels. With padding in each of the sides of the bottom portion 31, the baby's legs and hips may be further supported. In some configurations, it may be desirable to not include padding in the middle portion 35 of the main panel 25 as the middle portion supports the baby's torso and groin area, and it may be more desirable to transfer weight from the groin area to the hips.

Figure 5:
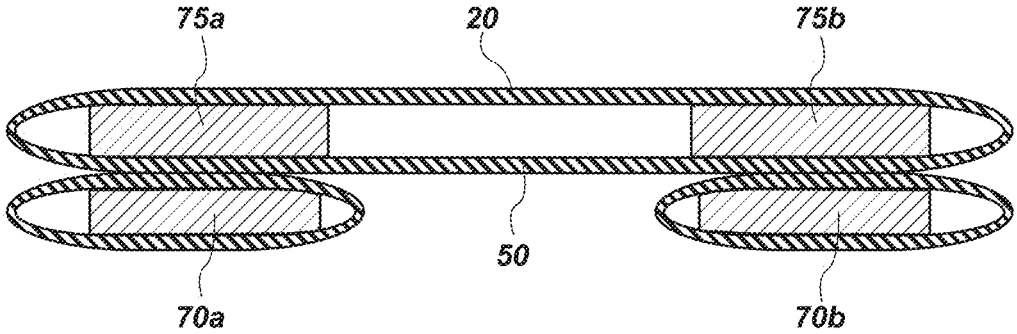
FIG. 5 is a cut-away view of the baby carrier of FIG. 1 taken along line 5-5 of FIG. 1.

If padding is provided in both the sides of the bottom portion 31 of the main panel 25 and the selectively adjustable side panels 15*a*, 15*b*, such padding may overlap to provide support for the baby's hips (see FIG. 5, showing a cross-sectional view taken along line 5-5 of FIG. 1). In an outward-facing position, the baby's bottom would be located proximal to the middle portion 35 of the main panel 25 where, in some configurations, there may be no padding or foam. The baby's legs may be placed through the cut-outs 45, 47 and lifted into proper, hip-healthy position by the padding provided in the folder-over side panels 15*a*, 15*b* and/or additionally supported by the firmer padding located at each side of the bottom portion 31 of the main panel.

In some configurations, it may be desirable to provide padding along a top edge of the main panel, such as a strip of foam 78 (shown in dashed lines in FIGS. 1 and 3). Such padding may be useful if the baby falls asleep in an outward facing position and their head leans forward, and may also provide further structure to the carrier.

In use, a caregiver or user may first decide if they wish the infant, baby, toddler, or child to be in an outward-facing position or an inward facing position. For example, if the caregiver desires an inward facing position, they may attach the first selectively adjustable side panel 15*a* to the first connector 52, and the second selectively adjustable side panel 15*b* to the second connector 55. The caregiver then places the carrier, with the back side 50 facing outwardly and the front side 20 facing towards them around their waist. With the waist portion 28 around their waist, the caregiver connects the buckle, ring, or other connector, to the waist strap. The caregiver then picks up the infant, baby, child, or toddler and places them on their chest, with the baby facing inward towards the caregiver. The caregiver then lifts the carrier up and around the back of the baby, and places each of their arms through the shoulder straps. The caregiver may then attach one or more buckles at their back to connect the shoulder straps, and adjust the shoulder straps, waist strap, etc., as necessary.

For example, if the caregiver desires an outward-facing position, they may attach the first selectively adjustable side panel 15*a* to the third connector 58 and the second selectively adjustable side panel 15*b* to the third connector 58 (as shown in FIG. 4). The caregiver then places the carrier, with the back side 50 facing outwardly and the front side 20 facing towards them around their waist. With the waist support portion 28 around their waist, the caregiver connects the buckle, ring, or other connector, to the waist strap. The caregiver then picks up the infant, baby, child, or toddler and places them on their chest, with the baby facing outward away from the caregiver. The caregiver then lifts the carrier up and around the torso of the baby, with the baby's right leg passing through the opening provided by the first cut-out 45, and the baby's left leg passing through the opening provided by the second cut-out 47. The caregiver may then place each of their arms through the shoulder straps. The caregiver may then attach one or more buckles at their back to connect the shoulder straps, and adjust the shoulder straps, waist strap, etc., as necessary.

Additionally, if the caregiver already has the waist strap around their waist and the baby in the carrier, it may be possible to switch from the outward-facing configuration to the inward-facing configuration without having to entirely remove the carrier from the caregiver's body. For example, if the caregiver has the carrier in an outward facing position (with the selectively adjustable side panels 15*a*, 15*b* each connected to the third connector 58), but the baby seems over-stimulated or needs to sleep, the caregiver may securely hold the baby with one arm and slip their arms out of the shoulder straps. With one had still securely holding the baby against their torso, the caregiver may use the other hand to detach the first and second selectively adjustable side panels 15*a*, 15*b* from the third connector 58, and then connect the side panel 15*a* to the first connector 52 and connect the side panel 15*b* to the second connector 55. The caregiver may then place then carrier back up over the back of the baby (with the baby in an inward-facing position, and place the shoulder straps over each of their shoulders and secure the shoulder straps together behind their back.

While methods of carrying a baby on the front of a caregiver are described (including a baby facing inwardly and outwardly), the carrier may also be used to carry a baby on the caregiver's back.

Herein is disclosed a baby carrier which in some configuration comprises a main panel, the main panel forming a child carrying area in cooperation with a wearer's torso, the main panel having a waist support portion, a bottom portion, a top portion, a first and a second opposing side edge, a middle portion, and a front side and a back side; wherein the main panel further comprises padding within the bottom portion of the main panel; a first arcuate cut-out formed in the main panel from the first opposing side edge towards the middle portion of the main panel and a second arcuate cut-out formed in the main panel from the second opposing side edge towards the middle portion of the main panel, a first connector attached to the back side of the main panel proximal to the first opposing side edge and above the first arcuate cut-out, and a second connector attached to the back side of the main panel proximal to the second opposing side edge and above the second arcuate cut-out, the first connector configured to mate with a first side panel connector located proximal to a top of a first selectively adjustable side panel and the second connector configured to mate with a second side panel connector located proximal to a top of a second selectively adjustable side panel; a third connector attached to the back side of the main panel in the middle portion and below the first and second connectors, the third connector configured to mate with the first and second side panel connectors on the first and second selectively adjustable side panels; the first and second selectively adjustable side panels having an inward facing position when the first selectively adjustable side panel is connected to the first connector of the main panel and the second selectively adjustable side panel is connected to the second connector of the main panel, and an outward facing position when the first and second selectively adjustable side panels are connected to the third connector of the main panel; and wherein the first and second selectively adjustable side panels further comprise padding located within the first and second selectively adjustable side panels.

In some configurations, the padding within the bottom portion of the main panel comprises a first piece of foam disposed within the bottom portion and towards one opposing side edge, and a second piece of foam disposed within the bottom portion and towards the second opposing side edge. In some configurations, there is no padding disposed within the middle portion of the bottom portion of the main panel, thus forming a portion with no padding for the baby's bottom to be positioned within in an outward-facing carry.

According to one aspect, the first and second selectively adjustable side panels have a bottom edge and a top edge, and wherein the bottom edge is non-removably attached to the bottom portion of the main panel. In other configurations, the bottom edge is removably attached to the bottom portion of the main panel. A strip of foam may be provided within the top portion of the main panel.

A child carrier as disclosed herein may include: a main panel, the main panel forming a child carrying area in cooperation with a wearer's torso, the main panel having a waist support portion, a bottom portion, a top portion, a first and a second opposing side edge, a middle portion, a front side and a back side; a first cut-out formed in the main panel from the first opposing side edge towards the middle portion of the main panel and a second cut-out formed in the main panel from the second opposing side edge towards the middle portion of the main panel; a first selectively adjustable side panel configured to selectively cover the first cut-out and a second selectively adjustable side panel configured to selectively cover the second cut-out; a first connector attached to the back side of the main panel proximal to the first opposing side edge and above the first arcuate cut-out, a second connector attached to the back side of the main panel proximal to the second opposing side edge and above the second arcuate cut-out, the first connector configured to mate with a first side panel connector located proximal to a top of the first selectively adjustable side panel and the second connector configured to mate with a second side panel connector located proximal to a top of the second selectively adjustable side panel; a third connector attached to the back side of the main panel proximal to the middle portion and below the first and second connectors, the third connector configured to mate with the first side panel connector and the second side panel connector; the first and second selectively adjustable side panels having an inward facing position when the first selectively adjustable side panel is connected to the first connector of the main panel and the second selectively adjustable side panel is connected to the second connector of the main panel, and an outward facing position when the first and second selectively adjustable side panels are not connected to the first and second connector of the main panel.

In some configurations, the first and second selectively adjustable side panels have the outward facing position when the first and second selectively adjustable side panels are connected to the third connector of the main panel. The main panel may include padding within the bottom portion of the main panel. The padding within the bottom portion of the main panel may comprise a first portion of padding towards a first side of the middle portion and a second portion of padding towards a second side of the middle portion.

The first and second cut-outs of the main panel may have a generally arcuate shape, and the main panel may have a generally hourglass shape.

In some embodiments, the first and second selectively adjustable side panels further comprise padding located within the first and second selectively adjustable side panels. The padding may comprise a piece of soft foam. The main panel may also include a first piece of foam within the bottom portion towards a first side of the middle portion and a second piece of foam within the bottom portion towards a second side of the middle portion. There may be no padding or foam disposed in the middle of the bottom portion of the main panel.

The soft foam of the first and second selectively adjustable side panels, the first piece of foam of the main panel, and the second piece of foam of the main panel, may work in conjunction to form a hip-supporting portion configured to support hips of the child in a spread-squat position when the first and second selectively adjustable side panels are in the outward facing position.

The first selectively adjustable side panel and second selectively adjustable side panel may be non-removably attached to the bottom portion of the main panel, or may be removably attached to the bottom portion of the main panel in an inward-facing position and removed entirely for an outward-facing position.

The various embodiments described above, including elements of the various embodiments described above, can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A child carrier comprising: a main panel, the main panel forming a child carrying area in cooperation with a wearer's torso, the main panel having a waist support portion, a bottom portion, a top portion, a first and a second opposing side edge, a middle portion, and a front side and a back side, wherein the back side of the main panel faces the wearer's torso; wherein the main panel further comprises padding within the bottom portion of the main panel; a first arcuate cut-out formed in the main panel from the first opposing side edge towards the middle portion of the main panel and a second arcuate cut-out formed in the main panel from the second opposing side edge towards the middle portion of the main panel, a first connector attached to the back side of the main panel proximal to the first opposing side edge and above the first arcuate cut-out, and a second connector attached to the back side of the main panel proximal to the second opposing side edge and above the second arcuate cut-out, the first connector configured to mate with a first side panel connector located proximal to a top of a first selectively adjustable side panel and the second connector configured to mate with a second side panel connector located proximal to a top of a second selectively adjustable side panel, the first and second selectively adjustable side panels having a front side and a back side; a third connector attached to the back side of the main panel in the middle portion and below the first and second connectors, the third connector configured to mate with the first and second side panel connectors on the first and second selectively adjustable side panels; the first and second selectively adjustable side panels having an inward facing position wherein the child faces the wearer's torso when the first selectively adjustable side panel is connected to the first connector on the back side of the main panel and the second selectively adjustable side panel is connected to the second connector of the main panel, and the front side of each of the first and second selectively adjustable side panels faces away from the wearer, and an outward facing position wherein the child faces away from the wearer's torso when the first and second selectively adjustable side panels are connected to the third connector on the back side of the main panel, and at least a portion of the front side of each of the first and second selectively adjustable side panels faces toward the wearer; and wherein the first and second selectively adjustable side panels further comprise padding located within the first and second selectively adjustable side panels, and wherein, in the outward facing position wherein the child faces away from the wearer's torso, the padding within the first and second selectively adjustable side panels form a support for hips of the child.

2. The child carrier of claim 1, wherein the padding within the bottom portion of the main panel comprises a first piece of foam disposed within the bottom portion and towards one opposing side edge, and a second piece of foam disposed within the bottom portion and towards the second opposing side edge.

3. The child carrier of claim 2, wherein there is no padding disposed within the middle portion of the bottom portion of the main panel.

4. The child carrier of claim 1, wherein the first and second selectively adjustable side panels have a bottom edge and a top edge, and wherein the bottom edge is non-removably attached to the bottom portion of the main panel.

5. The child carrier of claim 1, further comprising a strip of foam within the top portion of the main panel.

6. A child carrier comprising: a main panel, the main panel forming a child carrying area in cooperation with a wearer's torso, the main panel having a waist support portion, a bottom portion, a top portion, a first and a second opposing side edge, a middle portion, a front side and a back side, the back side facing the wearer's torso; a first cut-out formed in the main panel from the first opposing side edge towards the middle portion of the main panel and a second cut-out formed in the main panel from the second opposing side edge towards the middle portion of the main panel; a first selectively adjustable side panel configured to selectively cover the first cut-out and a second selectively adjustable side panel configured to selectively cover the second cut-out, the first and second selectively adjustable side panels each having a front side; a first connector attached to the back side of the main panel proximal to the first opposing side edge and above the first arcuate cut-out, a second connector attached to the back side of the main panel proximal to the second opposing side edge and above the second arcuate cut-out, the first connector configured to mate with a first side panel connector located at the back side of the main panel facing the wearer's torso and proximal to a top of the first selectively adjustable side panel and the second connector configured to mate with a second side panel connector located at the back side of the main panel facing the wearer's torso and proximal to a top of the second selectively adjustable side panel; the first and second selectively adjustable side panels having an inward facing position wherein the child faces the wearer when the first selectively adjustable side panel is connected to the first connector at the back side of the main panel and the second selectively adjustable side panel is connected to the second connector at the back side of the main panel, and the front side of each of the first and second selectively adjustable side panels faces away from the wearer, and an outward facing position wherein the child faces away from the wearer when the first and second selectively adjustable side panels are connected to each other at the back side of the main panel folded towards the middle portion of the back side of the main panel facing the wearer's torso, and the front side of each of the first and second selectively adjustable side panels faces the child, the folded first and second selectively adjustable side panels forming a support on the back side of the main panel for hips of the child.

7. The child carrier of claim 6, wherein the main panel further comprises padding within the bottom portion of the main panel.

8. The child carrier of claim 7, wherein the padding within the bottom portion of the main panel comprises a first portion of padding towards a first side of the middle portion and a second portion of padding towards a second side of the middle portion.

9. The child carrier of claim 6, wherein the first cut-out has a generally arcuate shape and the second cut-out has a generally arcuate shape.

10. The child carrier of claim 9, wherein the main panel has a generally hourglass shape.

11. The child carrier of claim 7, wherein the first and second selectively adjustable side panels further comprise padding located within the first and second selectively adjustable side panels.

12. The child carrier of claim 11, wherein the padding comprises a piece of soft foam.

13. The child carrier of claim 12, wherein the main panel further comprises a first piece of foam within the bottom portion towards a first side of the middle portion and a second piece of foam within the bottom portion towards a second side of the middle portion.

14. The child carrier of claim 13, wherein there is no padding disposed in the middle of the bottom portion of the main panel.

15. The child carrier of claim 13, wherein the soft foam of the first and second selectively adjustable side panels, the first piece of foam of the main panel, and the second piece of foam of the main panel, work in conjunction to form the support configured to support hips of the child in a spread-squat position when the first and second selectively adjustable side panels are in the outward facing position.

16. The child carrier of claim 6, wherein the first selectively adjustable side panel and second selectively adjustable side panel are non-removably attached to the bottom portion of the main panel.

17. A child carrier comprising: a main panel, the main panel forming a child carrying area in cooperation with a wearer's torso, the main panel having a waist support portion, a bottom portion, a top portion, a first and a second opposing side edge, a middle portion, a front side and a back side, wherein the back side of the main panel faces the wearer's torso; a first cut-out formed in the main panel from the first opposing side edge towards the middle portion of the main panel and a second cut-out formed in the main panel from the second opposing side edge towards the middle portion of the main panel; a first selectively adjustable side panel configured to selectively cover the first cut-out and a second selectively adjustable side panel configured to selectively cover the second cut-out, each of the first and second selectively adjustable side panels having a front side; a first connector attached to the back side of the main panel proximal to the first opposing side edge and above the first arcuate cut-out, a second connector attached to the back side of the main panel proximal to the second opposing side edge and above the second arcuate cut-out, the first connector configured to mate with a first side panel connector located proximal to a top of the first selectively adjustable side panel and the second connector configured to mate with a second side panel connector located proximal to a top of the second selectively adjustable side panel; the first and second selectively adjustable side panels having an inward facing position when the first selectively adjustable side panel is connected to the first connector of the main panel and the second selectively adjustable side panel is connected to the second connector of the main panel, and the front sides of the first and second selectively adjustable side panels are facing outwardly from the wearer, and an outward facing position when the first and second selectively adjustable side panels are connected to each other at the back side of the main panel facing the wearer's torso, forming a support for hips of the child at the back side of the main panel, at least a portion of the front sides of each of the first and second selectively adjustable side panels facing the wearer.

18. The child carrier of claim 17, wherein the main panel further comprises a first piece of foam within the bottom portion towards a first side of the middle portion and a second piece of foam within the bottom portion towards a second side of the middle portion.

19. The child carrier of claim 17, wherein the first selectively adjustable side panel further comprises a first piece of foam disposed therein, and the second selectively adjustable side panel further comprises a second piece of foam disposed therein, and wherein the first piece of foam of the main panel and first piece of foam of the first selectively adjustable side panel form a first side of a hip support and wherein the second piece of foam of the main panel and the second piece of foam of the second selectively adjustable side panel form a second side of the hip support at the back side of the main panel facing the wearer's torso.

20. The child carrier of claim 17, wherein the first and second selectively adjustable side panels are removably attached to the carrier.

* * * * *